US007227970B2

(12) United States Patent
Calderwood et al.

(10) Patent No.: US 7,227,970 B2
(45) Date of Patent: Jun. 5, 2007

(54) SHORTING RING FIXTURE FOR ELECTROMAGNETIC TRANSDUCER

(75) Inventors: Richard C. Calderwood, Portland, OR (US); Enrique M. Stiles, Imperial Beach, CA (US)

(73) Assignee: STEP Technologies Inc., Minneapolis, MN (US)

( * ) Notice: Subject to any disclaimer, the term of this patent is extended or adjusted under 35 U.S.C. 154(b) by 636 days.

(21) Appl. No.: 10/788,827

(22) Filed: Feb. 26, 2004

(65) Prior Publication Data

US 2005/0190945 A1 Sep. 1, 2005

(51) Int. Cl.
*H04R 25/00* (2006.01)

(52) U.S. Cl. ..... 381/412; 381/421; 381/422

(58) Field of Classification Search ..... 381/396, 381/400, 401, 412, 414, 419–422; 335/302, 335/306

See application file for complete search history.

(56) References Cited

U.S. PATENT DOCUMENTS

| | | | | |
|---|---|---|---|---|
| 6,542,617 | B1 * | 4/2003 | Fujihira et al. | 381/402 |
| 6,671,385 | B2 * | 12/2003 | Suzuki et al. | 381/412 |
| 6,768,806 | B1 * | 7/2004 | Button et al. | 381/401 |
| 6,996,247 | B2 * | 2/2006 | Stiles | 381/412 |

* cited by examiner

*Primary Examiner*—Curtis Kuntz
*Assistant Examiner*—Tuan Duc Nguyen
(74) *Attorney, Agent, or Firm*—Richard Calderwood

(57) ABSTRACT

An electromagnetic transducer such as an audio speaker, having a motor structure in which a shorting ring that sinks eddy currents also serves as a permanent fixture to provide coaxial alignment of two or more components within the transducer. These components could include various combinations of the yoke, the top plate, the magnet, and/or other parts. Ideally, the shorting ring extends axially as close as possible to the voice coil, to a position immediately adjacent the magnetic air gap.

15 Claims, 7 Drawing Sheets

SHORTING RING FIXTURE FOR ELECTROMAGNETIC TRANSDUCER

BACKGROUND OF THE INVENTION

1. Technical Field of the Invention

This invention relates generally to electromagnetic transducers such as audio speakers, and more specifically to a shorting ring which also serves as an axial alignment fixture within the motor structure.

2. Background Art

FIG. 1 illustrates a conventional internal magnet geometry motor structure 10 for use in an electromagnetic transducer such as an audio loudspeaker. The motor structure includes a magnetically conductive cup style yoke 11 which includes a cylindrical portion 12 and a back plate portion 13. A magnetically conductive cup spacer 14 may be present to increase bottoming clearance, and it may be magnetically coupled to or integrally formed with the cup. A permanent magnet 15 is magnetically coupled to the spacer, and a magnetically conductive top plate 16 is magnetically coupled to the permanent magnet. The top plate and the cylindrical portion of the cup define a magnetic air gap 17 within which the electromagnetic transducer's voice coil (not shown) travels.

It is important, for correct operation of the transducer, that the various components remain coaxially aligned, as illustrated. If one or more components become misaligned, the acoustic performance may suffer, and the loudspeaker may even be damaged, such as by the voice coil assembly striking or rubbing on the motor structure components.

Conventionally, coaxial alignment is initially provided during manufacturing, by the use of a jig or fixture which is used to align the components for gluing, and which is subsequently withdrawn after the glue sets. The need to withdraw the fixture prevents the manufacture of some motor structure geometries, and adds to the manufacturing cost. Mistakes in fixturing cause reduction in manufacturing yield, raising the effective cost of correctly manufactured parts.

After manufacturing, coaxial alignment of most components is maintained by the integrity of the glues which are used to couple the magnet to the cup, and to couple the top plate to the magnet. If other, more mechanical means are employed, such as bolts, they raise the manufacturing cost without providing any acoustic or other performance advantage.

What is needed, then, is an improved fixture that becomes a functional component improving the motor structure's performance, that does not significantly raise the manufacturing cost, that improves the long-term reliability of the motor structure, and that provides a mechanical alignment which is not dependent upon e.g. glue reliability.

Many manufacturers subject speaker drivers to drop testing. Glue layers increase magnetic reluctance in the magnetic circuit in proportion to the thickness of the glue layers. What is further desirable, then, is an improved motor structure which requires less glue and therefore thinner glue layers, while having improved resistance to sheer failure in drop testing.

BRIEF DESCRIPTION OF THE DRAWINGS

The invention will be understood more fully from the detailed description section given below and from the accompanying drawings of embodiments of the invention which, however, should not be taken to limit the invention to the specific embodiments described, but are for explanation and understanding only.

DETAILED DESCRIPTION

Figure 1:
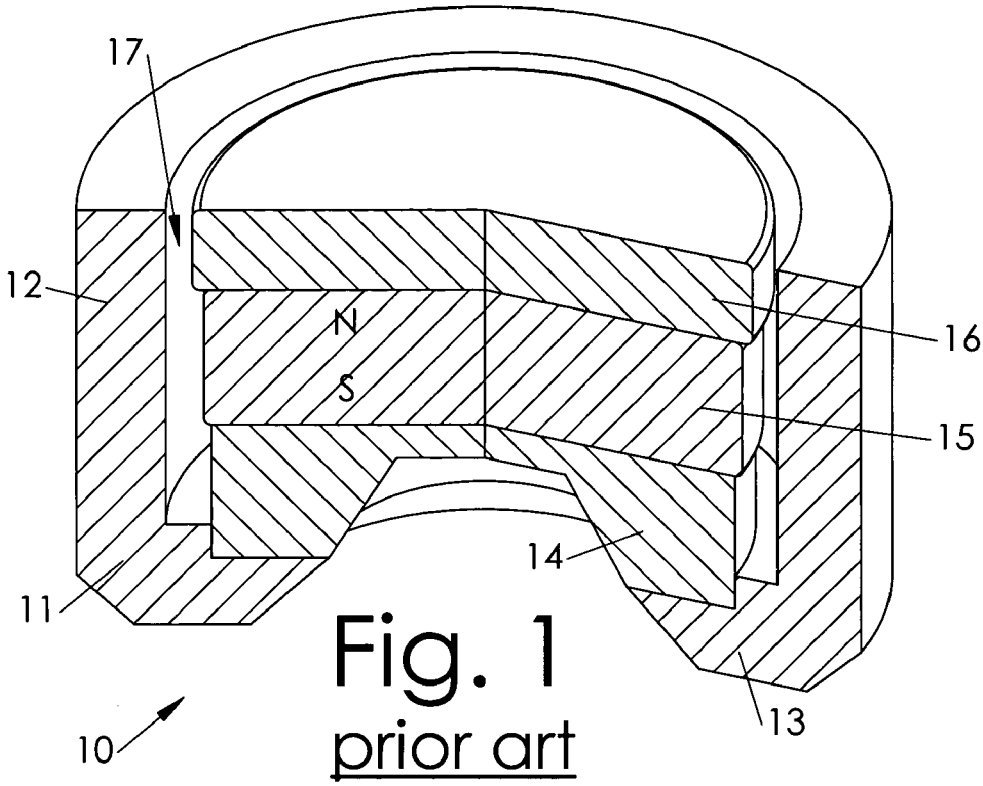
Fig. 1 prior art
FIG. 1 shows an internal magnet geometry motor structure according to the prior art.
Figure 2:
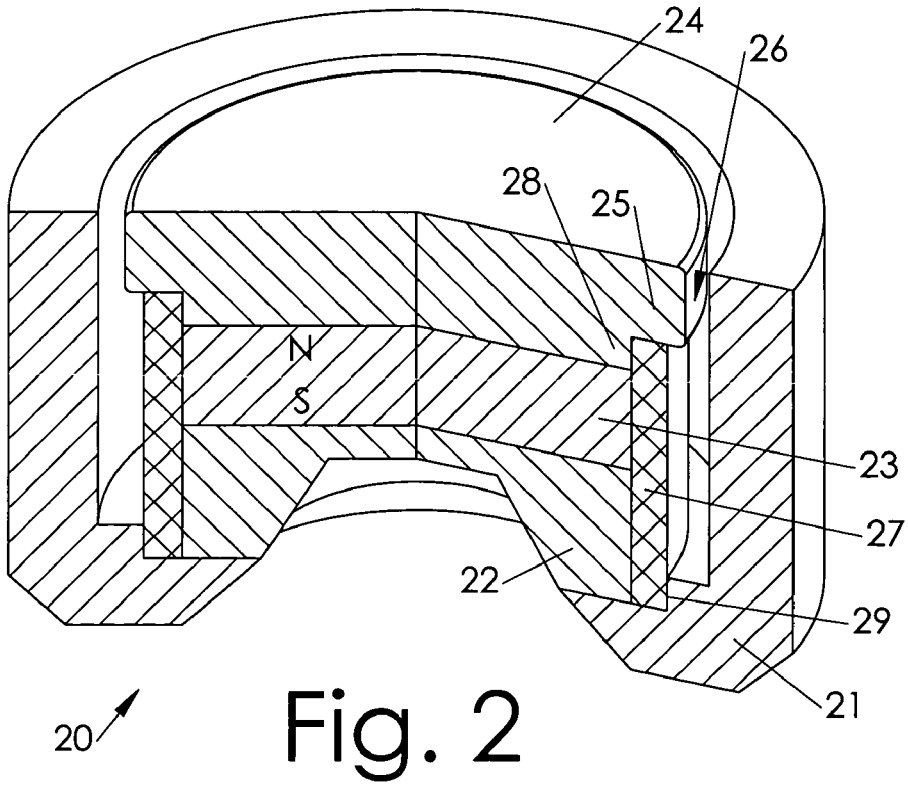
FIG. 2 shows an internal magnet geometry motor structure according to one embodiment of this invention.

FIG. 2 illustrates an internal magnet geometry motor structure 20 according to one embodiment of this invention. The motor structure includes a magnetically conductive cup 21 and, optionally, a magnetically conductive spacer 22 magnetically coupled to or integrally formed with the cup. A permanent magnet 23 is magnetically coupled to the spacer or the cup, and a top plate 24 is magnetically coupled to the permanent magnet. The top plate includes a primary portion 25 which defines a magnetic air gap 26 with the cylindrical portion of the cup.

The outer diameters of at least portions of at least two of the components are sized to closely fit within a shorting ring fixture 27 which serves double duty—it sinks induced eddy currents to reduce heating of the motor structure and to lower distortion, and it serves as a fixture keeping the enclosed components in proper coaxial alignment.

In one embodiment, the shorting ring fixtures the top plate and the permanent magnet. In this case, the top plate includes a lower portion 28 which has a smaller outer diameter than the primary portion of the top plate which defines the magnetic air gap. The permanent magnet may include a similarly reduced outer diameter portion, or, as shown, the entire permanent magnet may have a reduced outer diameter to fit within the shorting ring fixture. In a somewhat less optimal embodiment, the entire top plate could have the reduced outer diameter, and the shorting ring could extend over the entire top plate, but at a penalty of increased magnetic flux reluctance of the motor structure's magnetic circuit.

In the embodiment illustrated, the shorting ring fixtures the top plate, the permanent magnet, and the spacer. Furthermore, the shorting ring fixtures this central assembly coaxially with the cup, in that the outer diameter of the shorting ring mates with the inner diameter of a notch, groove, or step 29 in the cup. In another embodiment, the shorting ring fixtures just the permanent magnet and the spacer (or cup). In yet another embodiment, the shorting ring fixtures the spacer or cup and the top plate, and the OD of the magnet is smaller than the ID of the shorting ring (and thus the magnet is not fixtured by the shorting ring).

The shorting ring fixture does not necessarily have the same inner and outer diameters along its entire height. For example, its inner diameter may decrease at the point where the permanent magnet meets the top plate, to enable magnet overhang, reducing stray field losses.

Figure 3:
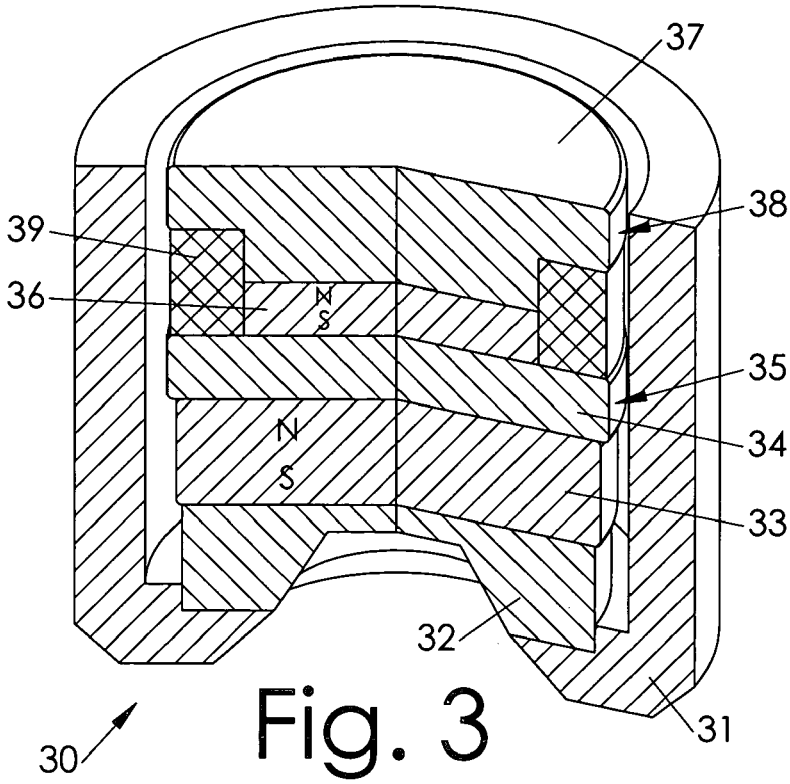
FIG. 3 shows another embodiment of this invention, with different components fixtured by the shorting ring.

FIG. 3 illustrates an internal magnet geometry motor structure 30 according to another embodiment of this invention. The motor structure includes a cup 31 and, optionally, a separate or integral spacer 32. A lower permanent magnet 33 is coupled to the spacer or the cup. A lower plate 34 is coupled to the lower permanent magnet and defines a lower magnetic air gap 35 with the cup. An upper magnet 36, which may be a permanent magnet (as shown) or e.g. steel, is coupled to the lower plate, and an upper plate 37 is coupled to the magnetic material member. The upper plate defines an upper magnetic air gap 38 with the cup. The upper plate and the upper magnet are fixtured by a shorting ring fixture 39.

If the spacer is magnetically conductive and the two magnets are polarized in the same direction, the magnetic flux over the two magnetic air gaps will be in a same direction, and the motor structure is such as those taught in co-pending patent application Ser. No. 10/289,109 "Push-Push Multiple Magnetic Air Gap Transducer" filed Oct. 31, 2003 by the present invention's co-inventor Enrique Stiles. That application and the present application are commonly owned. Alternatively, the spacer can be non magnetically conductive, such as made of aluminum, the upper magnet is a permanent magnet, the bottom magnet can be omitted or oppositely polarized, and the motor structure has a push-pull geometry in which the magnetic flux flows in opposite directions over the two magnetic air gaps.

Figure 4:
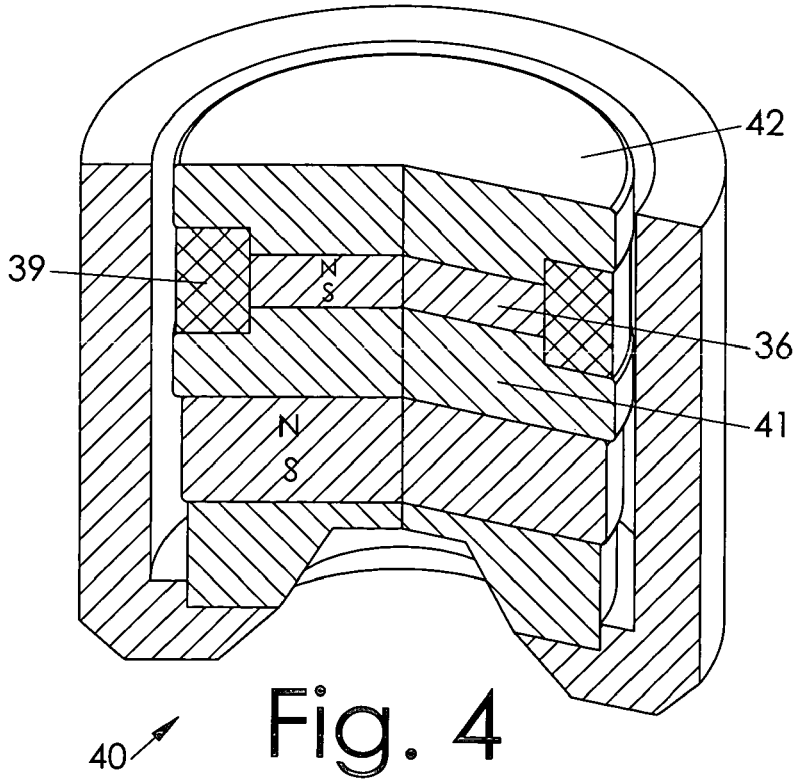
FIG. 4 shows another embodiment of this invention, having a reduced bill of materials part count.

FIG. 4 illustrates an internal magnet geometry motor structure 40 according to another embodiment of this invention. In effect, the upper magnet 36 has simply been slid upward in the motor structure, allowing the shorting ring 39 to fixture the lower plate 41, the upper magnet, and the upper plate 42. In one embodiment, such as that shown, the top and bottom plates are mirror images of each other, and two units of the same actual part can be used in both locations, simply by flipping one of them upside down.

Figure 5:
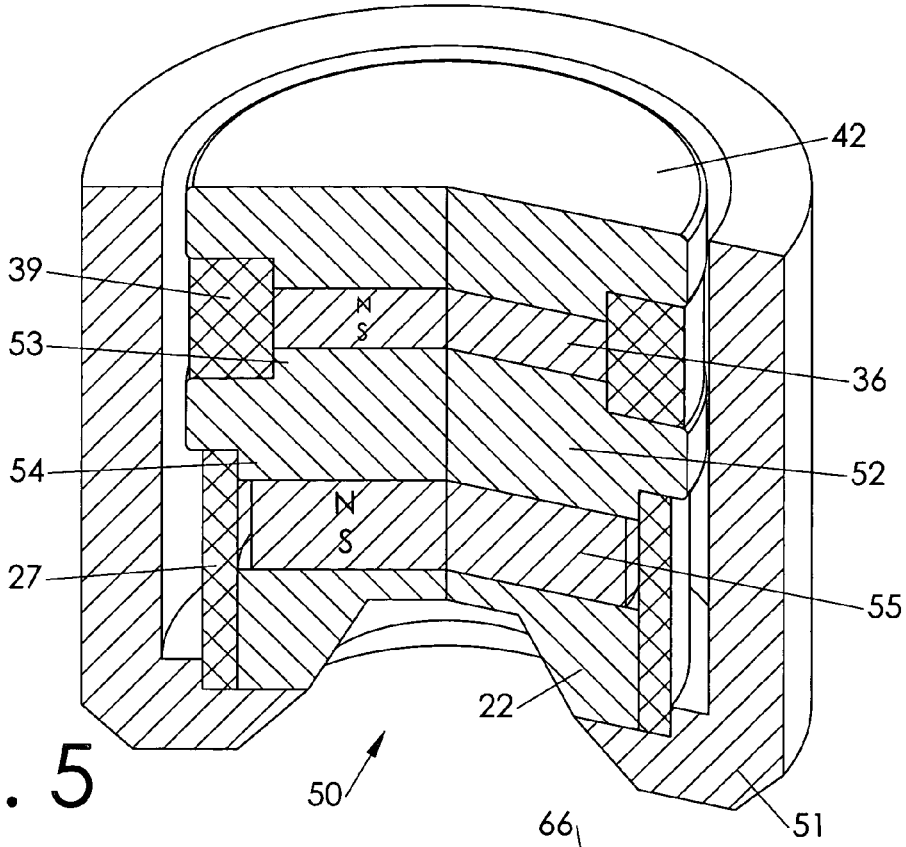
FIG. 5 shows another embodiment of this invention utilizing two shorting ring fixtures.

FIG. 5 illustrates an internal magnet geometry motor structure 50 according to another embodiment of this invention. It includes a cup 51 and a lower plate 52, and uses the upper plate 42, the upper magnet 36, and the shorting ring 39 of FIG. 4, and the shorting ring 27 and the spacer 22 of FIG. 2. The upper shorting ring 39 fixtures the upper plate 42, the upper magnet 36, and an upper portion 53 of the upper plate. The lower shorting ring 27 fixtures the cup, the spacer, and a lower portion 54 of the lower plate. Neither the inner diameters, outer diameters, nor heights of the two shorting ring fixtures are necessarily identical. In particular, the skilled engineer will select inner diameters by carefully trading off shorting ring cross-sectional area against permanent magnet size. Larger permanent magnets provide greater magnetic flux, all other things being equal. More shorting ring cross-sectional area provides lower electrical resistance, greater fixture strength, and other benefits.

In one embodiment, the lower magnet 55 has a smaller OD than the ID of the shorting ring fixture 27. Thus, the shorting ring 27 fixtures the cup and/or the spacer, and the plate 52, without fixturing the intervening magnet 55. In another embodiment, the lower magnet is sized such that it, too, is fixtured by the lower shorting ring.

Figure 6:
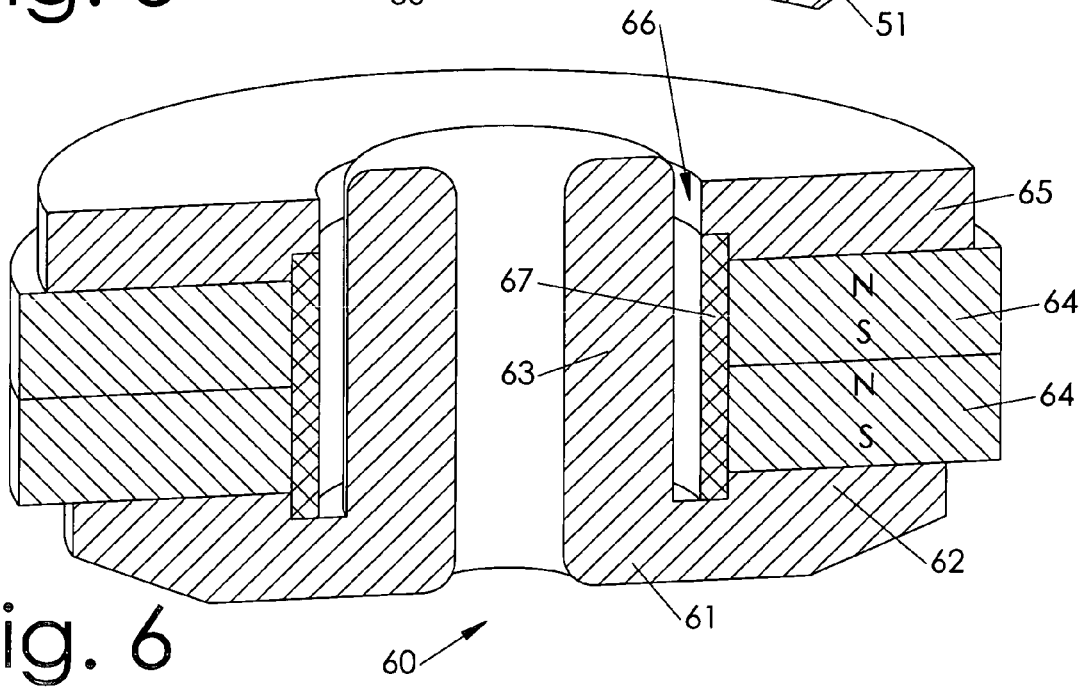
FIG. 6 shows an external magnet geometry motor structure embodiment of this invention.

FIG. 6 illustrates an external magnet geometry motor structure 60 according to another embodiment of this invention. The motor structure includes a magnetically conductive pole plate style yoke 61 which includes a back plate 62 and a pole piece 63. The pole piece and the back plate are either magnetically coupled or of integral construction (as shown). One or more permanent ring magnets 64 are magnetically coupled to the back plate. A magnetically conductive top plate 65 is magnetically coupled to the topmost permanent magnet. A primary portion of the top plate defines a magnetic air gap 66 with the pole piece. The inner diameters of the permanent magnets and a lower portion of the top plate are dimensioned to be fixtured by a shorting ring fixture 67. The back plate includes a notch, groove, or step which is dimensioned to also be fixtured by the shorting ring fixture.

Figure 7:
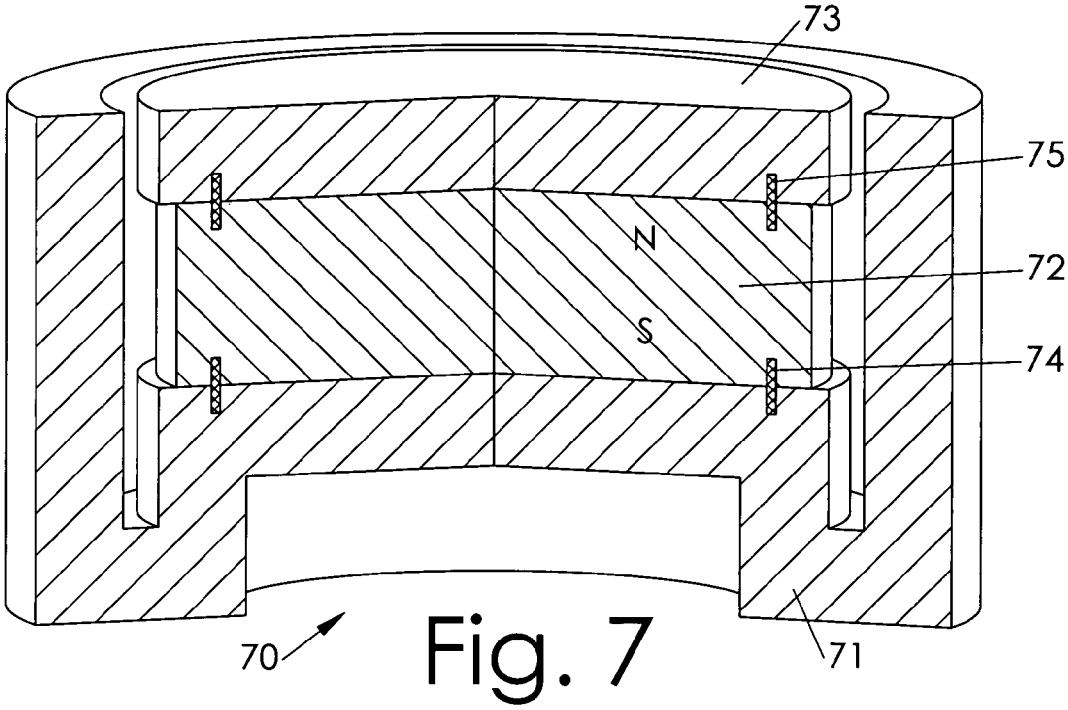
FIGS. 7 and 8 show another embodiment of this invention, with buried shorting ring fixtures.
Figure 8:
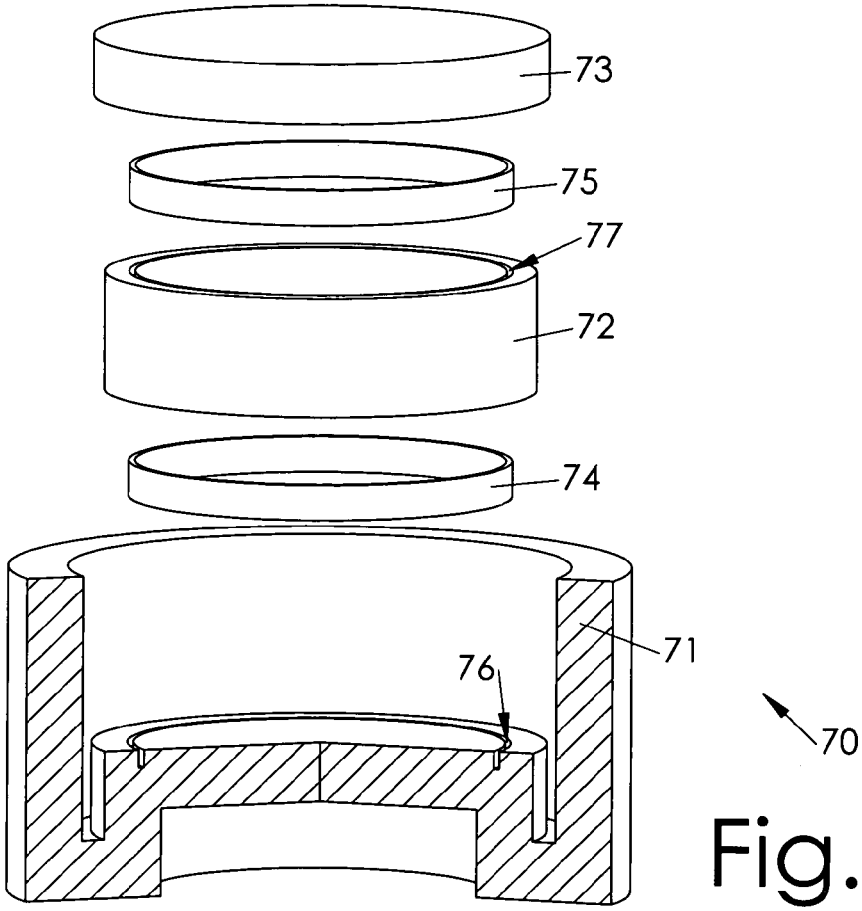

FIGS. 7 and 8 illustrate an internal magnet geometry motor structure 70 according to another embodiment of this invention, in conventional and exploded views, respectively. The motor structure includes a cup 71. A permanent magnet 72 is coupled between the cup and a top plate 73. A lower shorting ring 74 fixtures the cup and the magnet, and an upper shorting ring 75 fixtures the magnet and the top plate. The shorting rings are not necessarily exposed to the region where the voice coil (not shown) travels, but, instead, they may be buried somewhat inside the motor structure. For example, the lower shorting ring may fit into an annular groove 76 in the cup and a corresponding annular groove in the bottom of the magnet, and the upper shorting ring may fit into an annular groove 77 in the top of the magnet and a corresponding annular groove in the bottom of the top plate.

Figure 9:
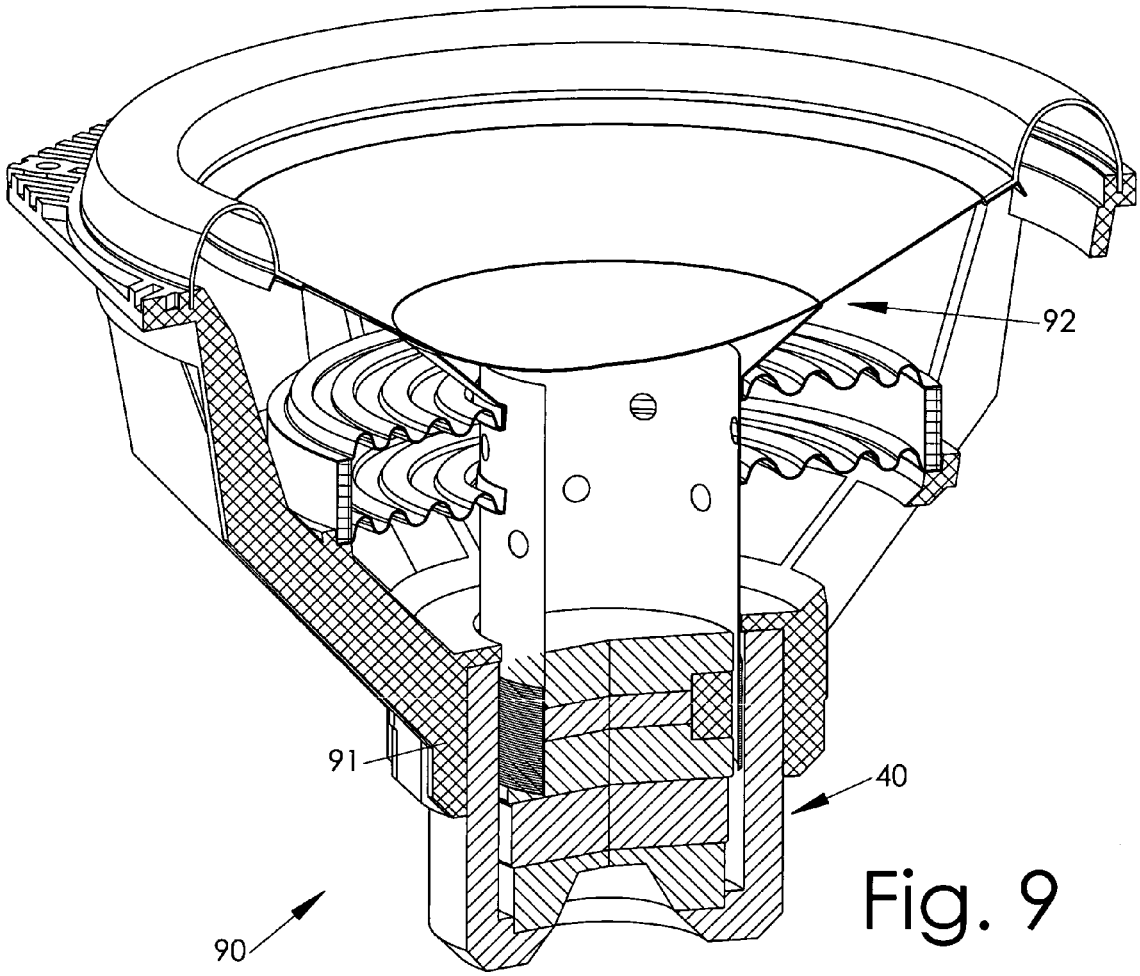
FIG. 9 shows an exemplary speaker driver utilizing this invention.

FIG. 9 illustrates one embodiment of an audio speaker driver 90 according to the principles of this invention. The speaker driver includes the motor structure 40 of FIG. 4, a frame 91 coupled to the motor structure, and a diaphragm assembly 92 coupled to the frame and including one or more voice coils disposed within the magnetic air gaps of the motor structure. When an alternating electrical current is applied to the voice coil, the voice coil will generate a magnetic field reacting with the field traversing the magnetic air gap in the motor structure magnetic circuit, causing the diaphragm to alternately be driven toward and away from the motor structure, generating acoustic waves. The magnetic field from the voice coil will induce eddy currents in the motor structure, but these will largely be confined to the low electrical resistance shorting rings. The shorting rings thereby reduce eddy current heating of the other, higher electrical resistance motor structure parts and reduce distortion of the sound produced by the speaker driver. The shorting rings also keep the fixtured motor structures in correct alignment.

Figure 10:
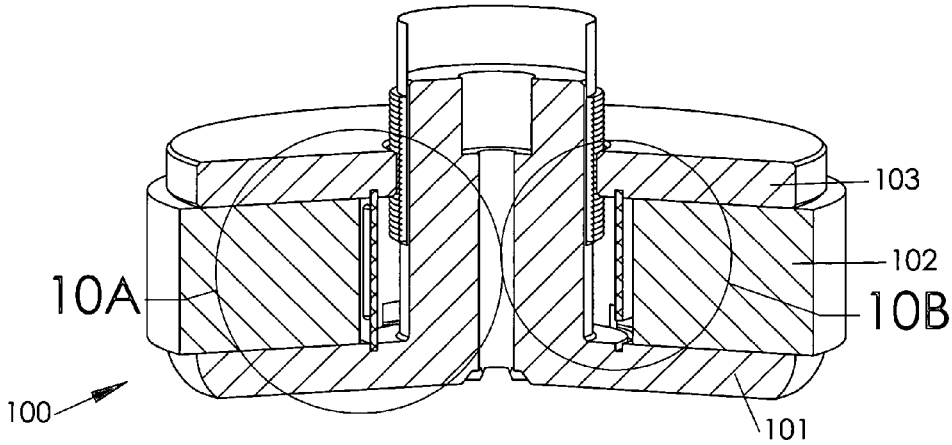
FIG. 10 shows another speaker driver utilizing this invention, in which the shorting ring fixtures the soft magnetic components.

FIG. 10 and detail views 10A and 10B illustrate another audio speaker driver 100 according to another embodiment of this invention. In the interest of clarity, cross-hatching has been omitted from the detail views. The speaker driver has a motor structure which includes a pole plate 101, a permanent magnet 102, and a top plate 103. A shorting ring 104 fixtures the pole plate and the top plate. The bottom end of the shorting ring fits into a groove 105 in the pole plate, and the top end of the shorting ring fits into a groove 106 in the top plate.

Optionally, the bottom end of the top plate is equipped with one or more notches 107 which permit airflow from the region of the voice coil 108 inside the shorting ring to the outer side of the shorting ring. And, optionally, the top plate may be equipped with one or more holes 109 through which this airflow may further pass. The ID of the magnet is larger than the OD of the shorting ring fixture, such that there is a space 110 through which the airflow may pass in going between the notches 107 and the holes 109.

It is generally understood that some permanent magnets, especially ceramic magnets such as are commonly used in external magnet geometry motor structures, are difficult and expensive to machine. Their thickness and flatness must generally be fairly well controlled, because those are directly related to how parallel the other motor components can be positioned, and how consistently the voice coil can be axially positioned. However, small variations in the ID or OD of the magnet are less critical; these are generally not machined, and are not held to as tight a tolerance as the thickness of the magnet.

Because the top plate ID defines the magnetic air gap and is usually smaller than the magnet ID, it is typically much more important that the top plate be held in a carefully controlled position. Thus, the shorting ring fixture is very useful in positioning the top plate with respect to the pole plate. The steel of the top plate and the pole plate are comparatively easy and inexpensive to accurately manufacture, versus the ceramic or other material of the magnet. Therefore, the shorting ring fixture as illustrated enables tight tolerance positioning of the top plate and pole plate, while allowing for significant variance in the ID or the axial positioning of the magnet.

Figure 11:
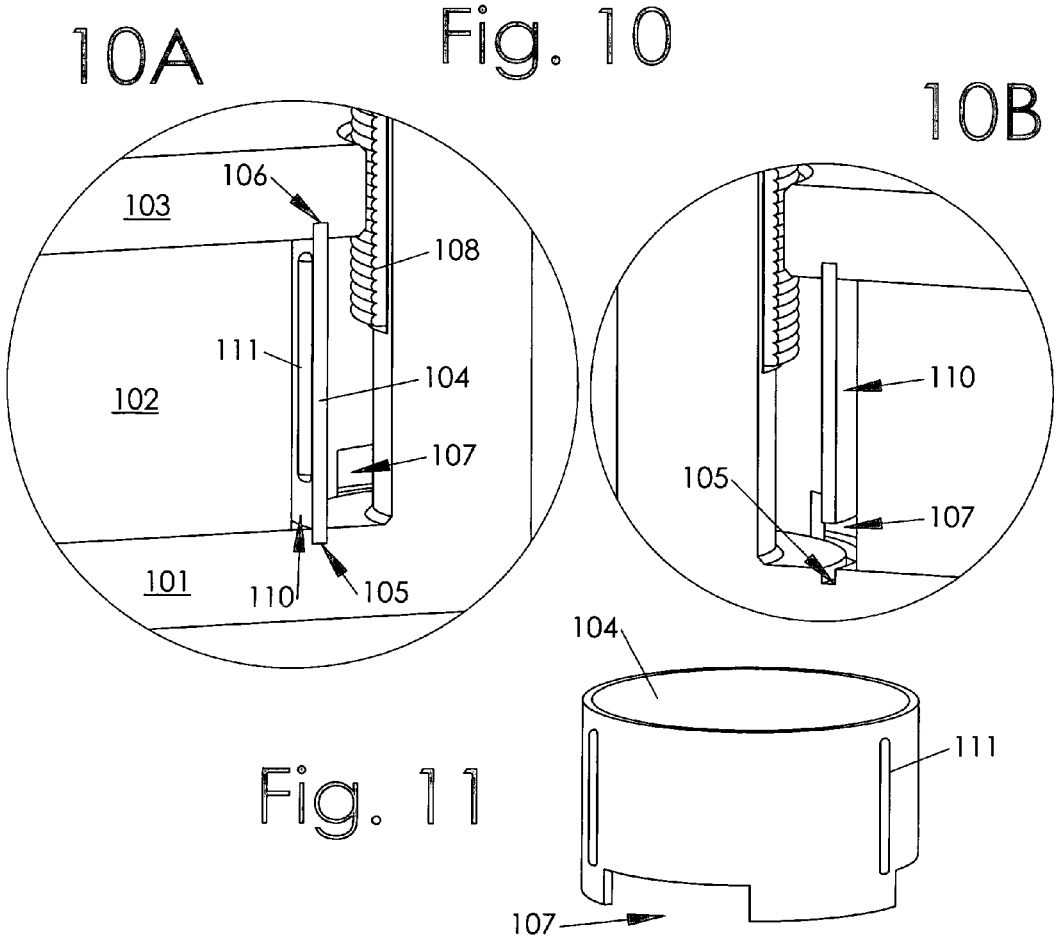
FIG. 11 shows the shorting ring fixture used in FIG. 10.

FIG. 11 illustrates the shorting ring fixture 104, including its optional airflow notches 107. Also illustrated are one or more, and preferably at least three, bumps or ridges 111 which extend radially to help position the permanent magnet and hold it away from the OD of the shorting ring, preventing obstruction of the air passage 110 between the OD of the shorting ring and the ID of the magnet, and also prevent gross misalignment of the magnet concentricity with respect to the rest of the motor structure.

Figure 12:
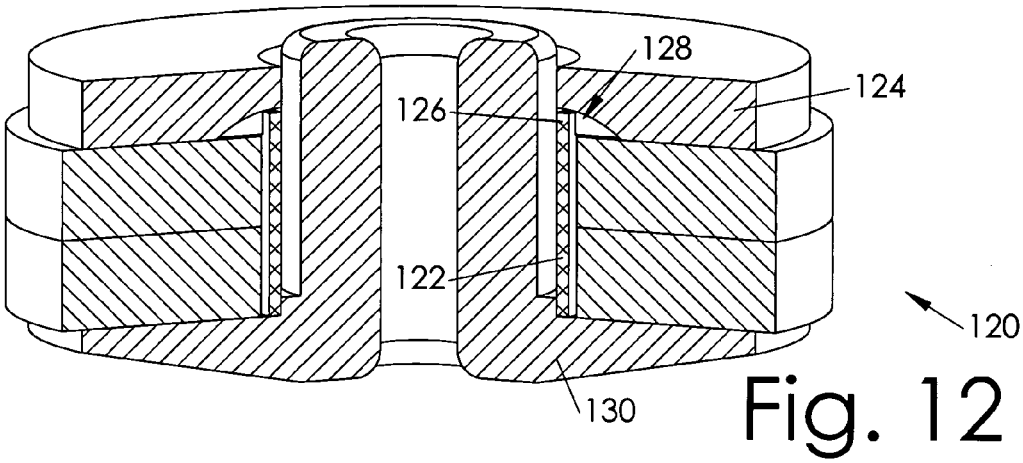
FIGS. 12 and 13 show another embodiment of a motor structure shorting ring fixture.
Figure 13:
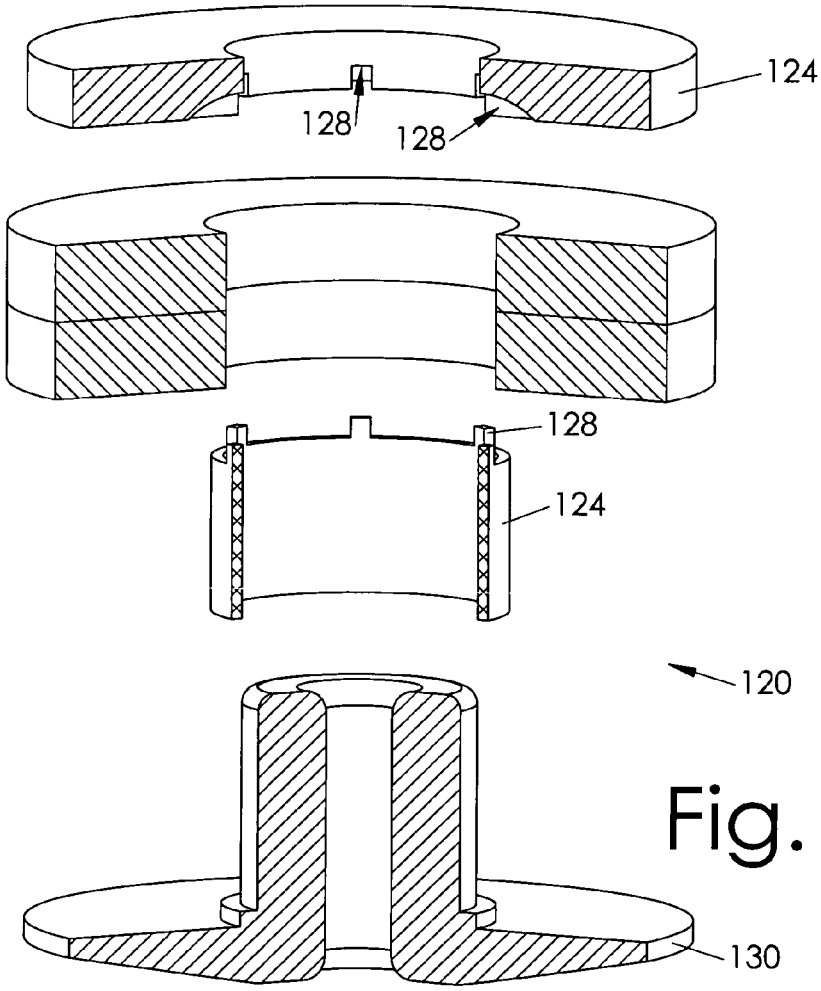

FIG. 12 illustrates another embodiment of a motor structure 120 in which a top portion of a shorting ring fixture 122 accomplishes the fixturing in a slightly different manner than others illustrated above. The previously described shorting rings fixture components by substantially mating with their ID or OD. By way of contrast, the shorting ring 122 fixtures e.g. the top plate 124 by tangential or radial engagement. The shorting ring fixture includes three or more axially extending fixturing tabs 126 which engage corresponding radial grooves 128 in the top plate. The shorting ring also fixtures e.g. the back plate 130 in either the tangential manner, or, as shown, the ID/OD manner. FIG. 13 illustrates the motor structure 120 in an exploded view.

CONCLUSION

The various features illustrated in the figures may be combined in many ways, and should not be interpreted as though limited to the specific embodiments in which they were explained and shown.

Other parts may be similarly aligned by one or more shorting ring fixtures, such as bucking magnets, frames, and the like.

The motor structure can be said to include a "magnet and plate stack" of at least one permanent magnet and at least one plate. A bottommost one of the permanent magnets is coupled to the yoke (either mechanically and/or magnetically, depending upon the motor structure configuration). The shorting ring fixture may be used to fixture a permanent magnet and a plate, or two adjacent permanent magnets, or two plates or other soft magnetic material members, or plates and yokes but not magnets.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An electromagnetic transducer motor structure comprising:

a yoke;

a magnet and plate stack of a plurality of components including, a first permanent magnet magnetically coupled to the yoke, a first magnetically conductive plate magnetically coupled to the first permanent magnet(s) and defining a first magnetic air gap with the yoke; and a first shorting ring fixture coupled to, and coaxially aligning, a set of fixtured components, wherein the set of fixtured components includes at least two of the yoke, the first permanent magnet, and the first plate.

2. The electromagnetic transducer motor structure of claim 1 wherein:

the set of fixtured components includes the yoke.

3. The electromagnetic transducer motor structure of claim 1 wherein:

the set of fixtured components includes the plate.

4. The electromagnetic transducer motor structure of claim 1 wherein:

the yoke comprises a cup;

the first permanent magnet comprises an internal magnet; and the first plate comprises an internal plate.

5. The electromagnetic transducer motor structure of claim 4 wherein:

the set of fixtured components includes the cup and the internal plate.

6. The electromagnetic transducer motor structure of claim 1 wherein:

the yoke comprises a pole plate;

the first permanent magnet comprises an external magnet; and the first plate comprises an external plate.

7. The electromagnetic transducer motor structure of claim 4 wherein:

the set of fixtured components includes the pole plate and the external plate.

8. The electromagnetic transducer motor structure of claim 1 wherein:

the shorting ring fixture is coupled to, and coaxially aligns, a first one of the fixtured components by one of an OD and an ID of the shorting ring fixture mating with the other of an OD and an ID of the first one of the fixtured components.

9. The electromagnetic transducer motor structure of claim 1 wherein:

the shorting ring fixture is coupled to, and coaxially aligns, a first one of the fixtured components by fitting into a groove in the first one of the fixtured components.

10. The electromagnetic transducer motor structure of claim 9 wherein:

the shorting ring fixture is coupled to, and coaxially aligns, a second one of the fixtured components by fitting into a groove in the second one of the fixtured components;

wherein the first and second ones of the fixtured components are adjacent each other, whereby the shorting ring fixture is buried within the motor structure.

11. The electromagnetic transducer motor structure of claim 1 wherein:

the magnet and plate stack further comprises a second magnetically conductive plate coupled between the permanent magnet and the yoke and defining a second magnetic air gap with the yoke; and the set of fixtured components includes the first plate and the second plate.

12. The electromagnetic transducer motor structure of claim 11 wherein:

the first and second plates are substantially mirror images of each other.

13. The electromagnetic transducer motor structure of claim 1 wherein:

the set of fixtured components includes the first plate; and wherein the first plate includes, a first portion which defines the magnetic air gap, and a second portion which has a smaller outer dimension than the first portion and which is disposed within and fixtured by the first shorting ring fixture.

14. The electromagnetic transducer motor structure of claim 1 further comprising:

a second shorting ring fixture coupled to, and coaxially aligning, a second set of components in the motor structure.

15. The electromagnetic transducer motor structure of claim 1 further comprising:

a frame coupled to the electromagnetic transducer motor structure;

a diaphragm assembly coupled to the frame; and a voice coil assembly coupled to the diaphragm assembly and including a voice coil disposed within the magnetic air gap.

* * * * *